US009897119B2

(12) United States Patent
Kawasaki et al.

(10) Patent No.: US 9,897,119 B2
(45) Date of Patent: Feb. 20, 2018

(54) CONTROL SYSTEM FOR HYBRID CONSTRUCTION MACHINE

(71) Applicant: KAYABA INDUSTRY CO., LTD., Tokyo (JP)

(72) Inventors: Haruhiko Kawasaki, Kanagawa (JP); Masahiro Egawa, Saitama (JP)

(73) Assignee: KYB Corporation, Tokyo (JP)

( * ) Notice: Subject to any disclaimer, the term of this patent is extended or adjusted under 35 U.S.C. 154(b) by 405 days.

(21) Appl. No.: 14/432,636

(22) PCT Filed: Nov. 1, 2013

(86) PCT No.: PCT/JP2013/079787
§ 371 (c)(1),
(2) Date: Mar. 31, 2015

(87) PCT Pub. No.: WO2014/073497
PCT Pub. Date: May 15, 2014

(65) Prior Publication Data

US 2015/0275938 A1 Oct. 1, 2015

(30) Foreign Application Priority Data

Nov. 7, 2012 (JP) ..... 2012-245559

(51) Int. Cl.
*F16D 31/02* (2006.01)
*F15B 21/14* (2006.01)
(Continued)

(52) U.S. Cl.
CPC ..... *F15B 21/14* (2013.01); *E02F 9/123* (2013.01); *E02F 9/2075* (2013.01);
(Continued)

(58) Field of Classification Search
CPC ..... F15B 21/14
(Continued)

(56) References Cited

U.S. PATENT DOCUMENTS 8,510,000 B2 * 8/2013 Kawasaki ..... F15B 21/14 180/275
2011/0071738 A1 3/2011 Kawasaki et al.
2014/0245729 A1 * 9/2014 Nanjo ..... F15B 21/14 60/414

FOREIGN PATENT DOCUMENTS

JP 2008-128478 A 6/2008
JP 2008-232307 A 10/2008
JP 2009-281525 A 12/2009

* cited by examiner

*Primary Examiner* — Michael Leslie
(74) *Attorney, Agent, or Firm* — Rabin & Berdo, P.C.

(57) ABSTRACT

A control system for a hybrid construction machine includes a turning-regeneration-use switching valve that opens when a pressure detected by a pressure detector reaches a turning-regeneration starting pressure, so as to introduce the working fluid from a turning circuit to a regenerative motor, an operating-state detector that detects an operating state of a fluid pressure cylinder; and a cylinder-regeneration-use switching valve that opens based on a detection result of the operating-state detector, so as to introduce the working fluid from the fluid pressure cylinder to the regenerative motor. When the turning regeneration is performed alone, the working fluid from the turning circuit is introduced into the regenerative motor without pressure reduction, When the turning regeneration and the cylinder regeneration are simultaneously performed, the working fluid from the turning circuit is reduced in pressure, joins the working fluid from the fluid pressure cylinder, and is introduced into the regenerative motor.

10 Claims, 3 Drawing Sheets

(51) Int. Cl.

| | |
|---|---|
| ***E02F 9/12*** | (2006.01) |
| ***E02F 9/20*** | (2006.01) |
| ***E02F 9/22*** | (2006.01) |
| ***F15B 11/10*** | (2006.01) |

(52) U.S. Cl.
CPC ..... *E02F 9/2095* (2013.01); *E02F 9/2217* (2013.01); *E02F 9/2235* (2013.01); *E02F 9/2282* (2013.01); *E02F 9/2285* (2013.01); *E02F 9/2292* (2013.01); *E02F 9/2296* (2013.01); *F15B 11/10* (2013.01); *F15B 2211/40515* (2013.01); *F15B 2211/41527* (2013.01); *F15B 2211/426* (2013.01); *F15B 2211/50554* (2013.01); *F15B 2211/6313* (2013.01); *F15B 2211/6658* (2013.01); *F15B 2211/7053* (2013.01); *F15B 2211/7058* (2013.01); *F15B 2211/7135* (2013.01)

(58) Field of Classification Search
USPC ..... 60/414
See application file for complete search history.

CONTROL SYSTEM FOR HYBRID CONSTRUCTION MACHINE

TECHNICAL FIELD

The present invention relates to a control system for a hybrid construction machine that includes a regeneration apparatus for performing energy regeneration using working fluid introduced from an actuator.

BACKGROUND ART

As a conventional hybrid construction machine, a known hybrid construction machine rotates a hydraulic motor using working oil introduced from a turning motor so as to perform energy regeneration.

JP2009-281525A discloses that an electromagnetic switching valve is switched to the opening position to perform turning regeneration and the degree of opening of a proportional electromagnetic throttle valve disposed in parallel to a relief valve is controlled to reduce the passage resistance of the relief valve when a pressure signal of a pressure sensor that detects a turning pressure during turning or a brake pressure during braking of the turning motor reaches a preliminarily set pressure.

SUMMARY OF INVENTION

The prior art described above controls the degree of opening of the proportional electromagnetic throttle valve to maintain the turning pressure of the turning motor. Thus, the regenerative control is complicated. In the case where the degree of opening of the proportional electromagnetic throttle valve becomes large, the turning pressure of the turning motor is reduced, the electromagnetic switching valve is switched to the closed position, and then the turning regeneration is stopped. Subsequently, when the turning motor is turning, the turning pressure is increased again, the electromagnetic switching valve is switched to the opening position, and then the turning regeneration is restarted. In this way, the electromagnetic switching valve may repeat opening and closing. In the case where this situation occurs, the pressure variation due to opening and closing of the electromagnetic switching valve may cause vibration.

To avoid this situation, the degree of opening of the proportional electromagnetic throttle valve may be controlled to be small. However, in this case, the regeneration amount becomes small. Thus, the efficiency is poor.

An object of the present invention is to provide a control system for a hybrid construction machine that allows efficient regeneration with a simple regenerative control.

According to one aspect of the present invention, a control system for a hybrid construction machine includes a fluid pressure pump as a driving source of a turning motor and a fluid pressure cylinder; a regenerative motor for regeneration configured to rotate by a working fluid introduced from a turning circuit for driving the turning motor and a working fluid introduced from the fluid pressure cylinder; a rotating electrical machine coupled to the regenerative motor; a pressure detector configured to detect a turning pressure during a turning operation or a brake pressure during a braking operation of the turning motor; a turning-regeneration-use switching valve configured to open when a pressure detected by the pressure detector reaches a preliminarily set turning-regeneration starting pressure, so as to introduce the working fluid from the turning circuit to the regenerative motor for turning regeneration; an operating-state detector configured to detect an operating state of the fluid pressure cylinder; and a cylinder-regeneration-use switching valve disposed in parallel to the turning-regeneration-use switching valve, the cylinder-regeneration-use switching valve being configured to open on the basis of a detection result of the operating-state detector, so as to introduce the working fluid from the fluid pressure cylinder to the regenerative motor for cylinder regeneration. When the turning regeneration is performed alone, the working fluid from the turning circuit is introduced into the regenerative motor without pressure reduction. When the turning regeneration and the cylinder regeneration are simultaneously performed, the working fluid from the turning circuit is reduced in pressure, joins the working fluid from the fluid pressure cylinder, and is introduced into the regenerative motor.

DESCRIPTION OF EMBODIMENTS

Figure 1:
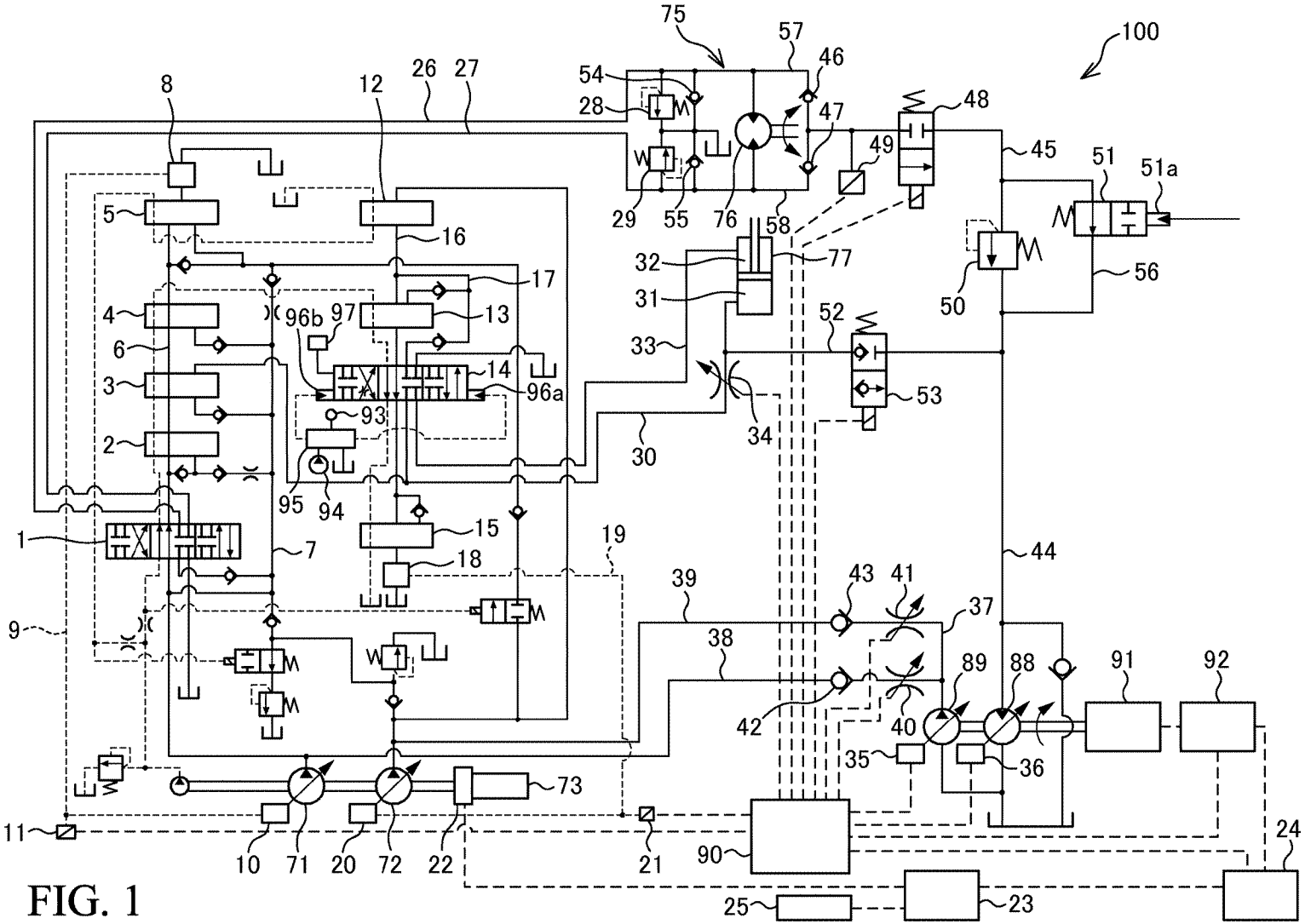
FIG. 1 is a circuit diagram illustrating a control system for a hybrid construction machine according to a first embodiment of the present invention.

The following describes control systems for a hybrid construction machine according to embodiments of the present invention with reference to the drawings. In the following embodiments, a description will be given of the case where the hybrid construction machine is a hydraulic shovel.

<First Embodiment>

A description will be given of a control system 100 for a hybrid construction machine according to a first embodiment of the present invention with reference to FIG. 1.

A hydraulic shovel includes first and second main pumps 71 and 72 as fluid pressure pumps driven by an engine 73. The first and second main pumps 71 and 72 are variable-displacement type pumps with adjustable tilting angles, and rotate coaxially with each other.

The working oil (working fluid) to be discharged from the first main pump 71 is supplied to an operation valve 1, an operation valve 2 for arm first speed, an operation valve 3 for boom second speed, an operation valve 4, and an operation valve 5 in this order from the upstream side. The operation valve 1 controls a turning motor 76. The operation valve 2 for arm first speed controls an arm cylinder (not illustrated). The operation valve 3 for boom second speed controls a boom cylinder 77. The operation valve 4 controls an auxiliary attachment (not illustrated). The operation valve 5 controls a first travel motor (not illustrated) for left traveling. The respective operation valves 1 to 5 control the flows of the working oil to be introduced from the first main pump 71 into respective actuators, so as to control the operations of the respective actuators. The respective operation valves 1 to 5 are operated by the pilot pressure to be supplied in association with the manual operation of the operating lever by the operator of the hydraulic shovel.

The respective operation valves 1 to 5 are connected to the first main pump 71 through a neutral flow path 6 and a parallel flow path 7 in parallel to each other. On the downstream side of the operation valve 5 in the neutral flow path 6, a pilot-pressure generating mechanism 8 for generating a pilot pressure is provided. The pilot-pressure generating mechanism 8 generates a high pilot pressure on the upstream side when the passing flow is large while generating a low pilot pressure on the upstream side when the passing flow is small.

When all of the operation valves 1 to 5 are in the neutral position or adjacent to the neutral position, the neutral flow path 6 introduces all or a part of the working oil discharged from the first main pump 71 into the tank. At this time, the flow passing through the pilot-pressure generating mechanism 8 is increased. Thus, a high pilot pressure is generated.

On the other hand, when the operation valves 1 to 5 are switched to the full-stroke states, the neutral flow path 6 is closed to stop the flow of the working oil. In this case, the flow passing through the pilot-pressure generating mechanism 8 becomes little and the pilot pressure remains zero. However, depending on the operating amounts of the operation valves 1 to 5, a part of the working oil discharged from the first main pump 71 is introduced into the actuators while the rest is introduced into the tank from the neutral flow path 6. Accordingly, the pilot-pressure generating mechanism 8 generates the pilot pressure corresponding to the flow of the working oil in the neutral flow path 6. That is, the pilot-pressure generating mechanism 8 generates the pilot pressure corresponding to the operating amounts of the operation valves 1 to 5.

The pilot-pressure generating mechanism 8 connects to a pilot flow path 9. Into the pilot flow path 9, the pilot pressure generated by the pilot-pressure generating mechanism 8 is introduced. The pilot flow path 9 is connected to a regulator 10 that controls the tilting angle of the first main pump 71. The regulator 10 controls the tilting angle of the first main pump 71 in inverse proportion to the pilot pressure in the pilot flow path 9 so as to control the displacement per one rotation of the first main pump 71. Accordingly, the operation valves 1 to 5 are switched to the full-stroke states to stop the flow in the neutral flow path 6. Then, when the pilot pressure in the pilot flow path 9 becomes zero, the tilting angle of the first main pump 71 becomes maximum. Thus, the displacement per one rotation becomes maximum.

The pilot flow path 9 is provided with a first pressure sensor 11 that detects the pressure in the pilot flow path 9.

The working oil to be discharged from the second main pump 72 is supplied to an operation valve 12, an operation valve 13, an operation valve 14 for boom first speed, and an operation valve 15 for arm second speed in this order from the upstream side. The operation valve 12 controls a second travel motor (not illustrated) for right traveling. The operation valve 13 controls a bucket cylinder (not illustrated). The operation valve 14 for boom first speed controls the boom cylinder 77. The operation valve 15 for arm second speed controls an arm cylinder (not illustrated). The respective operation valves 12 to 15 control the flows of the working oil to be introduced from the second main pump 72 into respective actuators, so as to control the operations of the respective actuators. The respective operation valves 12 to 15 are operated by the pilot pressure to be supplied in association with the manual operation of the operating lever by the operator of the hydraulic shovel.

The respective operation valves 12 to 15 are connected to the second main pump 72 through a neutral flow path 16. The operation valve 13 and the operation valve 14 are connected to the second main pump 72 through a parallel passage 17 in parallel to the neutral flow path 16. On the downstream side of the operation valve 15 in the neutral flow path 16, a pilot-pressure generating mechanism 18 for generating a pilot pressure is provided. The pilot-pressure generating mechanism 18 has the same function as that of the pilot-pressure generating mechanism 8 on the first main pump 71 side.

The pilot-pressure generating mechanism 18 connects to a pilot flow path 19. Into the pilot flow path 19, the pilot pressure generated by the pilot-pressure generating mechanism 18 is introduced. The pilot flow path 19 is connected to a regulator 20 that controls the tilting angle of the second main pump 72. The regulator 20 controls the tilting angle of the second main pump 72 in inverse proportion to the pilot pressure in the pilot flow path 19 so as to control the displacement per one rotation of the second main pump 72. Accordingly, the operation valves 12 to 15 are switched to the full-stroke states to stop the flow in the neutral flow path 16. Then, when the pilot pressure in the pilot flow path 19 becomes zero, the tilting angle of the second main pump 72 becomes maximum. Thus, the displacement per one rotation becomes maximum.

The pilot flow path 19 is provided with a second pressure sensor 21 that detects the pressure of the pilot flow path 19.

At the engine 73, an electric generator 22 is provided. The electric generator 22 generates electric power using the redundant force of the engine 73. The electric power generated by the electric generator 22 is charged to a battery 24 via a battery charger 23. The battery charger 23 allows charging the electric power to the battery 24 also in the case where the battery charger 23 is coupled to an ordinary household power supply 25.

Next, the turning motor 76 will be described.

The turning motor 76 is provided at a turning circuit 75 for driving the turning motor 76. The turning circuit 75 includes a pair of supply/discharge passages 26 and 27 and relief valves 28 and 29. The supply/discharge passages 26 and 27 connect the first main pump 71 with the turning motor 76. The operation valve 1 is provided in the supply/discharge passages 26 and 27. The relief valves 28 and 29 are connected to the respective supply/discharge passages 26 and 27 and open at the set pressures.

In the case where the operation valve 1 is in the neutral position (the state illustrated in FIG. 1), the actuator port of the operation valve 1 is closed. Accordingly, the supply and discharge of the working oil to/from the turning motor 76 are cut off. Thus, the turning motor 76 remains in the stop state.

When the operation valve 1 is switched to the right-side position in FIG. 1, the supply/discharge passage 26 is connected to the first main pump 71 while the supply/discharge passage 27 is communicated with the tank. Accordingly, the working oil is supplied through the supply/discharge passage 26 to turn the turning motor 76 and the working oil returning from the turning motor 76 is discharged to the tank through the supply/discharge passage 27. On the other hand, when the operation valve 1 is switched to the left-side position in FIG. 1, the supply/discharge passage 27 is connected to the first main pump 71 while the supply/discharge passage 26 is communicated with the tank. Accordingly, the turning motor 76 turns in the reverse direction.

In the case where the turning pressures in the supply/discharge passages 26 and 27 reach the respective set pressures of the relief valves 28 and 29 during the turning operation of the turning motor 76, the relief valves 28 and 29 open to introduce the excess flow on the high pressure side into the low pressure side.

When the operation valve 1 is switched to the neutral position during the turning operation of the turning motor 76, the actuator port of the operation valve 1 is closed.

Accordingly, the supply/discharge passages 26 and 27, the turning motor 76, and the relief valves 28 and 29 constitute a closed circuit. Even when the actuator port of the operation valve 1 is closed, the turning motor 76 continues rotating due to the inertial energy to exert the pumping action. Accordingly, a high pressure is provided in one passage among the supply/discharge passages 26 and 27 at low pressure during the turning operation while a low pressure is provided in the other passage among the supply/discharge passages 26 and 27 at high pressure during the turning operation. Thus, a braking force acts on the turning motor 76 to perform a braking operation. At this time, in the case where the brake pressures in the supply/discharge passages 26 and 27 reach the respective set pressures of the relief valves 28 and 29, the relief valves 28 and 29 open to introduce the brake flow on the high pressure side into the low pressure side.

In the case where the suction flow of the turning motor 76 becomes insufficient during the braking operation of the turning motor 76, the working oil of the tank is suctioned through check valves 54 and 55 that accept flows of the working oil only from the tank to the respective supply/discharge passages 26 and 27.

Next, the boom cylinder 77 will be described.

The operation valve 14 that controls the operation of the boom cylinder 77 is operated by the pilot pressure to be supplied to pilot chamber 96*a* or 96*b* from a pilot pump 94 through a pilot valve 95 in association with the manual operation of an operating lever 93 by the operator of the hydraulic shovel. The operation valve 3 for boom second speed is switched in conjunction with the operation valve 14.

In the case where the pilot pressure is supplied to the pilot chamber 96*a*, the operation valve 14 is switched to the right-side position in FIG. 1. Then, the working oil discharged from the second main pump 72 is supplied to a piston-side chamber 31 of the boom cylinder 77 through a supply/discharge passage 30, and the working oil returning from a rod-side chamber 32 is discharged to the tank through a supply/discharge passage 33. Thus, the boom cylinder 77 expands. On the other hand, in the case where the pilot pressure is supplied to the pilot chamber 96*b*, the operation valve 14 is switched to the left-side position in FIG. 1. Then, the working oil discharged from the second main pump 72 is supplied to the rod-side chamber 32 of the boom cylinder 77 through the supply/discharge passage 33, and the working oil returning from the piston-side chamber 31 is discharged to the tank through the supply/discharge passage 30. Thus, the boom cylinder 77 contracts. In the case where the pilot pressure is not supplied to the pilot chamber 96*a* or 96*b*, the operation valve 14 is switched to the neutral position (the state illustrated in FIG. 1). Accordingly, the supply and discharge of the working oil to/from the boom cylinder 77 are cut off. Thus, the boom remains in the stopped state.

In the case where the operation valve 14 is switched to the neutral position to stop the movement of the boom, a force in the contracting direction acts on the boom cylinder 77 due to own weights of the bucket, the arm, the boom, and so on. Thus, the boom cylinder 77 maintains the load using the piston-side chamber 31 in the case where the operation valve 14 is in the neutral position. The piston-side chamber 31 becomes a load-side pressure chamber.

The control system 100 for the hybrid construction machine includes a regeneration apparatus that recovers the energy of the working oil from the turning circuit 75 and the boom cylinder 77 to perform energy regeneration. The following describes this regeneration apparatus.

The regenerative control of the regeneration apparatus is performed by a controller 90. The controller 90 comprises a CPU, a ROM, and a RAM. The CPU executes a regenerative control. The ROM stores a control program, a setting value, and similar data required for the processing operation of the CPU. The RAM temporarily stores information detected by various sensors.

The supply/discharge passages 26 and 27 connected to the turning motor 76 connect to respective branch passages 57 and 58. The branch passages 57 and 58 are joined together to be connected to a turning regeneration passage 45 for introducing the working oil from the turning circuit 75 into a regenerative motor 88 for regeneration. The branch passages 57 and 58 include respective check valves 46 and 47 that accept flows of the working oil only from the respective supply/discharge passages 26 and 27 to the turning regeneration passage 45. The turning regeneration passage 45 is connected to the regenerative motor 88 through a junction regeneration passage 44.

The regenerative motor 88 is a variable displacement-type motor with an adjustable tilting angle, and is coupled to an electric motor 91 as a rotating electrical machine that doubles as an electric generator so as to rotate coaxially with each other. In the case where the electric motor 91 functions as the electric generator, the electric power generated by the electric motor 91 is charged to the battery 24 via an inverter 92. The regenerative motor 88 and the electric motor 91 may be directly coupled together or may be coupled together via a reducer.

The turning regeneration passage 45 is provided with a switching valve 48 as a turning-regeneration-use switching valve controlled by switching control using a signal output from the controller 90. Between the switching valve 48 and the check valves 46 and 47, a pressure sensor 49 is provided as a pressure detector that detects the turning pressure during the turning operation or the brake pressure during the braking operation of the turning motor 76. The pressure signal detected by the pressure sensor 49 is output to the controller 90.

When the solenoid is not energized, the switching valve 48 is set to the closed position (the state illustrated in FIG. 1) to block the turning regeneration passage 45. When the solenoid is energized, the switching valve 48 is set to the opening position to open the turning regeneration passage 45. In the case where the controller 90 determines that the pressure detected by the pressure sensor 49 reaches a turning-regeneration starting pressure that is preliminarily set, the controller 90 switches the switching valve 48 to the opening position. Accordingly, the working oil from the turning circuit 75 is introduced into the regenerative motor 88 so as to perform the turning regeneration. Thus, the switching valve 48 is a valve for performing the turning regeneration.

A description will be given of the path of the working oil from the turning circuit 75 to the regenerative motor 88. For example, during the turning operation in which the turning motor 76 is turned by the working oil supplied through the supply/discharge passage 26, the excess oil in the supply/discharge passage 26 flows in the turning regeneration passage 45 through the branch passage 57 and the check valve 46 and then introduced into the regenerative motor 88. During the braking operation in which the operation valve 1 is switched to the neutral position when the turning motor 76 is turned by the working oil supplied through the supply/discharge passage 26, the working oil discharged by the pumping action of the turning motor 76 flows in the turning regeneration passage 45 through the branch passage 58 and the check valve 47 and then introduced into the regenerative motor 88.

In the case where the turning-regeneration starting pressure for switching the switching valve 48 to the opening position is set to a pressure lower than the set pressures of the relief valves 28 and 29, the pressure of the turning circuit 75 might not remain at a pressure required for the turning operation or the braking operation of the turning motor 76 when the switching valve 48 is switched to the opening position. In the case where the turning-regeneration starting pressure is set to be similar to the set pressures of the relief valves 28 and 29, most of the excess flow during the turning operation of the turning motor 76 or most of the brake flow during the braking operation might flow to the relief valves 28 and 29 when the switching valve 48 is switched to the opening position. Accordingly, the regeneration amount might become small. Therefore, the turning-regeneration starting pressure is set to a pressure slightly lower than the set pressures of the relief valves 28 and 29 in order not to affect the turning operation or the braking operation of the turning motor 76 and to ensure the regeneration amount.

On the downstream side of the switching valve 48 in the turning regeneration passage 45, a pressure reducing valve 50 is disposed. The pressure reducing valve 50 is a fixed differential pressure valve that operates to have a fixed value of the differential pressure between the inlet and the outlet.

A bypass passage 56 that bypasses the pressure reducing valve 50 is connected to the turning regeneration passage 45. In the bypass passage 56, a bypass valve 51 that has a cut-off position and a communicating position is disposed. The bypass valve 51 is a pilot operated switching valve. The bypass valve 51 is set to a communicating position (the state illustrated in FIG. 1) in the normal state in which the pilot pressure is not supplied to a pilot chamber 51*a*. When the pilot pressure is supplied to the pilot chamber 96*b* of the operation valve 14, the pilot pressure at the same pressure is simultaneously supplied to the pilot chamber 51*a*. And then, the bypass valve 51 is set to the cut-off position. That is, the bypass valve 51 is set to the cut-off position by the pilot pressure for operating the operation valve 14 in the direction along which the piston-side chamber 31 of the boom cylinder 77 contracts. The bypass valve 51 is switched in conjunction with the contraction operation of the boom cylinder 77.

In the supply/discharge passage 30 that connects the piston-side chamber 31 with the operation valve 14 of the boom cylinder 77, an electromagnetic proportional throttle valve 34 is provided. The electromagnetic proportional throttle valve 34 controls the degree of opening by the output signal of the controller 90. The electromagnetic proportional throttle valve 34 maintains at the full-open position in the normal state.

A boom regeneration passage 52 as a cylinder regeneration passage is connected to the supply/discharge passage 30. The boom regeneration passage 52 branches from between the piston-side chamber 31 and the electromagnetic proportional throttle valve 34. The boom regeneration passage 52 is a passage for introducing the working oil returning from the piston-side chamber 31 into the regenerative motor 88. The turning regeneration passage 45 and the boom regeneration passage 52 are joined together and then connected to the junction regeneration passage 44.

The boom regeneration passage 52 is provided with a switching valve 53 as a cylinder-regeneration-use switching valve controlled by switching control using a signal output from the controller 90. When the solenoid is not energized, the switching valve 53 is set to the closed position (the state illustrated in FIG. 1) to block the boom regeneration passage 52. When the solenoid is energized, the switching valve 53 is set to the opening position to open the boom regeneration passage 52. The switching valve 48 and the switching valve 53 are provided in parallel to each other.

The operation valve 14 is provided with a sensor 97 that detects the operating direction and the operating amount of the operation valve 14. The signal detected by the sensor 97 is output to the controller 90. Detecting the operating direction and the operating amount of the operation valve 14 is equivalent to detecting the expansion/contraction direction and the expansion/contraction amount of the boom cylinder 77. Accordingly, the sensor 97 functions as an operating-state detector that detects the operating state of the boom cylinder 77. It should be noted that as the operating-state detector, instead of the sensor 97, a sensor that detects the movement direction and the movement amount of the piston rod may be provided at the boom cylinder 77 or a sensor that detects the operating direction and the operating amount of the operating lever 93 may be provided at the operating lever 93.

The controller 90 determines whether the operator intends to cause expansion or contraction of the boom cylinder 77 on the basis of the detection result of the sensor 97. When the controller 90 determines the expansion operation of the boom cylinder 77, the controller 90 maintains the electromagnetic proportional throttle valve 34 in the full-open position that is the normal state and maintains the switching valve 53 in the closed position. On the other hand, when the controller 90 determines the contraction operation of the boom cylinder 77, the controller 90 computes the contraction speed required by the operator for the boom cylinder 77 on the basis of the operating amount of the operation valve 14 and closes the electromagnetic proportional throttle valve 34 while switching the switching valve 53 to the opening position. Accordingly, all of the working oil returning from the boom cylinder 77 is introduced to the regenerative motor 88 to perform boom regeneration. However, when the flow consumed in the regenerative motor 88 is less than the necessary flow to maintain the contraction speed required by the operator for the boom cylinder 77. The boom cylinder 77 cannot maintain the contraction speed required by the operator. At this time, the controller 90 controls the degree of opening of the electromagnetic proportional throttle valve 34 to return a flow except the flow consumed by the regenerative motor 88 to the tank on the basis of the operating amount of the operation valve 14, the tilting angle of the regenerative motor 88, the rotational speed of the electric motor 91, and similar parameter so as to maintain the contraction speed required by the operator for the boom cylinder 77.

Next, a description will be given of a sub-pump 89 that assists the outputs of the first and second main pumps 71 and 72. The sub-pump 89 is a variable-displacement type pump with an adjustable tilting angle, and is coupled to the regenerative motor 88 to rotate coaxially with each other. The sub-pump 89 rotates by the drive force of the electric motor 91. The rotational speed of the electric motor 91 is controlled by the controller 90 through the inverter 92. The tilting angles of the sub-pump 89 and the regenerative motor 88 are controlled by the controller 90 through respective tilting angle controllers 35 and 36.

A discharge passage 37 is connected to the sub-pump 89. The discharge passage 37 is formed to branch into a first assist flow path 38 and a second assist flow path 39. The first assist flow path 38 joins the discharge side of the first main pump 71. The second assist flow path 39 joins the discharge side of the second main pump 72. The first and second assist flow paths 38 and 39 are provided with respective first and second electromagnetic proportional throttle valves 40 and 41 whose degrees of opening are controlled by the output signal of the controller 90. Additionally, the first and second assist flow paths 38 and 39 are provided with respective check valves 42 and 43 on the downstream sides of the first and second electromagnetic proportional throttle valves 40 and 41. The check valves 42 and 43 accept the flows of the working oil only from the sub-pump 89 to the respective first and second main pumps 71 and 72.

When the sub-pump 89 is rotated by the drive force of the electric motor 91, the sub-pump 89 assists the outputs of the first and second main pumps 71 and 72. The controller 90 controls the degrees of opening of the first and second electromagnetic proportional throttle valves 40 and 41 on the basis of the respective pressure signals from the first and second pressure sensors 11 and 21 in order to prorate the working oil discharged from the sub-pump 89 so as to supply the working oil to the discharge sides of the first and second main pumps 71 and 72.

When the working oil is supplied to the regenerative motor 88 through the junction regeneration passage 44 and then the regenerative motor 88 rotates, the rotational force of the regenerative motor 88 acts as an assist force on the electric motor 91 that rotates coaxially with the regenerative motor 88. Accordingly, the power consumption of the electric motor 91 can be reduced corresponding to the rotational force of the regenerative motor 88.

When the regenerative motor 88 is used as a driving source and the electric motor 91 is used as an electric generator, the tilting angle of the sub-pump 89 is set to zero to ensure an almost unloaded state.

The following describes the regenerative controls of the turning regeneration and the boom regeneration.

Firstly, a description will be given of the case where the turning regeneration is performed alone.

In the case where the controller 90 determines that the pressure detected by the pressure sensor 49 reaches the turning-regeneration starting pressure, the controller 90 switches the switching valve 48 to the opening position. Accordingly, the working oil from the turning circuit 75 is introduced into the regenerative motor 88. Thus, the turning regeneration is performed. On the other hand, in the case where the controller 90 determines that the boom cylinder 77 is during the expansion operation or stopped on the basis of the detection result of the sensor 97, the controller 90 set the switching valve 53 to the closed position. Accordingly, the working oil returning from the boom cylinder 77 is not introduced into the regenerative motor 88. Thus, the boom regeneration is not performed. Here, during the expansion operation or during the stop of the boom cylinder 77, the pilot pressure is not supplied to the pilot chamber 96*b* of the operation valve 14. Accordingly, the pilot pressure is not supplied to the pilot chamber 51*a* of the bypass valve 51. Thus, the bypass valve 51 is set to the communicating position. Accordingly, the working oil from the turning circuit 75 bypasses the pressure reducing valve 50 so as to be introduced into the regenerative motor 88 through the bypass valve 51.

Thus, in the case where the turning regeneration is performed alone, the bypass valve 51 is set to the communicating position. Then, the working oil from the turning circuit 75 is introduced to the regenerative motor 88 without pressure reduction by the pressure reducing valve 50. Accordingly, efficient regeneration is performed.

Here, in the case where the turning regeneration is performed alone, the working oil from the turning circuit 75 is introduced into the regenerative motor 88 without pressure reduction by the pressure reducing valve 50. Accordingly, the pressure of the turning circuit 75 is likely to be reduced. In the case where the pressure of the turning circuit 75 is decreased compared with the turning-regeneration starting pressure, the switching valve 48 is switched to the closed position and then the turning regeneration is stopped. Subsequently, when the turning motor 76 is during the turning operation, the pressure of the turning circuit 75 is increased again, the switching valve 48 is switched to the opening position at the turning-regeneration starting pressure, and then the turning regeneration is restarted. In this way, the switching valve 48 may repeat opening and closing. In the case where this situation occurs, the pressure variation due to opening and closing of the switching valve 48 may cause vibration.

Therefore, in the case where the turning regeneration is performed alone, the controller 90 controls the tilting angle and the rotational speed of the regenerative motor 88 such that the pressure detected by the pressure sensor 49 is not decreased compared with the turning-regeneration starting pressure so as to control the regeneration flow to be introduced into the regenerative motor 88. Specifically, the controller 90 computes a theoretical turning-regeneration flow from the pressure detected by the pressure sensor 49 so as to control the tilting angle and the rotational speed of the regenerative motor 88 such that the regeneration flow to be introduced into the regenerative motor 88 does not exceed the theoretical turning-regeneration flow. The theoretical turning-regeneration flow is computed using a map that specifies the relationship between the pressure detected by the pressure sensor 49 and the relief flow flowing through the relief valves 28 and 29. That is, the controller 90 refers to the map to compute the relief flow (theoretical turning-regeneration flow) flowing through the relief valves 28 and 29 from the pressure detected by the pressure sensor 49 so as to control the regeneration flow to be introduced into the regenerative motor 88 not to exceed the relief flow. Accordingly, even in the case where the turning regeneration is performed alone and the working oil from the turning circuit 75 is introduced into the regenerative motor 88 without pressure reduction by the pressure reducing valve 50, the pressure of the turning circuit 75 can be maintained at a pressure that does not affect the turning operation or the braking operation of the turning motor 76.

Next, a description will be given of the case where the turning regeneration and the boom regeneration are simultaneously performed.

In the case where the controller 90 determines that the pressure detected by the pressure sensor 49 reaches the turning-regeneration starting pressure, the controller 90 switches the switching valve 48 to the opening position. Accordingly, the working oil from the turning circuit 75 is introduced into the regenerative motor 88. Thus, the turning regeneration is performed. On the other hand, in the case where the controller 90 determines that the boom cylinder 77 is during the contraction operation on the basis of the detection result of the sensor 97, the controller 90 switches the switching valve 53 to the opening position. Accordingly, the working oil returning from the boom cylinder 77 is introduced into the regenerative motor 88. Thus, the boom regeneration is performed. Here, during the contraction operation of the boom cylinder 77, the pilot pressure is supplied to the pilot chamber 96*b* of the operation valve 14 and the pilot pressure is simultaneously supplied to the pilot chamber 51*a* of the bypass valve 51. Therefore, the bypass valve 51 is set to the cut-off position. Accordingly, the working oil from the turning circuit 75 is introduced into the regenerative motor 88 through the pressure reducing valve 50.

Thus, in the case where the turning regeneration and the boom regeneration are simultaneously performed, the bypass valve 51 is set to the cut-off position and then the working oil from the turning circuit 75 is reduced in pressure by the pressure reducing valve 50 so as to be introduced into the regenerative motor 88. Accordingly, the working oil from the turning circuit 75 is reduced in pressure and then joins the working oil returning from the boom cylinder 77, so as to be introduced into the regenerative motor 88.

The pressure of the working oil returning from the boom cylinder 77 is smaller than the pressure of the working oil from the turning circuit 75. The pressure reducing valve 50 functions to reduce the differential pressure between the working oil returning from the boom cylinder 77 and the working oil from the turning circuit 75. That is, the reduction in pressure of the working oil from the turning circuit 75 by the pressure reducing valve 50 ensures stably joining the working oil from the turning circuit 75 and the working oil returning from the boom cylinder 77 in the junction regeneration passage 44.

As described above, during the turning regeneration, the pressure variation due to opening and closing of the switching valve 48 may cause vibration. However, in the case where the turning regeneration and the boom regeneration are simultaneously performed, the working oil from the turning circuit 75 is reduced in pressure by the pressure reducing valve 50. Accordingly, the pressure of the turning circuit 75 is a pressure obtained by adding the pressure loss of the pressure reducing valve 50 to the pressure of the regenerative motor 88. This prevents reduction in pressure of the turning circuit 75, thus preventing the occurrence of vibration due to pressure reduction in the turning circuit 75.

According to the first embodiment described above, it is possible to obtain the following effects.

In the regenerative control of this embodiment, in the case where the turning regeneration is performed alone, the working oil from the turning circuit 75 is introduced into the regenerative motor 88 without pressure reduction by the pressure reducing valve 50. In the case where the turning regeneration and the boom regeneration are simultaneously performed, the working oil from the turning circuit 75 is reduced in pressure by the pressure reducing valve 50 and then introduced into the regenerative motor 88. Thus, this control is simple. Additionally, in the case where the turning regeneration is performed alone, the working oil from the turning circuit 75 is introduced into the regenerative motor 88 without pressure reduction. Thus, efficient regeneration is performed. This allows efficient regeneration with the simple regenerative control.

The following describes modifications of the first embodiment.

In the first embodiment, the case where the bypass valve 51 is the pilot operated switching valve has been described. Instead, the bypass valve 51 may be constituted by an electromagnetic valve. In this case, the bypass valve 51 is set to the cut-off position by a signal output from the controller 90 on the basis of the detection result of the sensor 97. Specifically, in the case where the controller 90 determines that the boom cylinder 77 is during the contraction operation on the basis of the detection result of the sensor 97, the controller 90 switches the bypass valve 51 to the cut-off position.

In the first embodiment, as an example for performing the regeneration using the working oil returning from the fluid pressure cylinder, the case using the working oil returning from the boom cylinder 77 has been described. However, instead of the boom cylinder 77, the working oil returning from the arm cylinder for driving the arm or the bucket cylinder for driving the bucket may be used to perform regeneration. In the case where the operation valves 2 and 13 are in the neutral positions, the arm cylinder and the bucket cylinder are frequently in the state where the load is maintained in the rod-side chamber. Therefore, the rod-side chamber may be set as the load-side pressure chamber.

<Second Embodiment>

Figure 2:
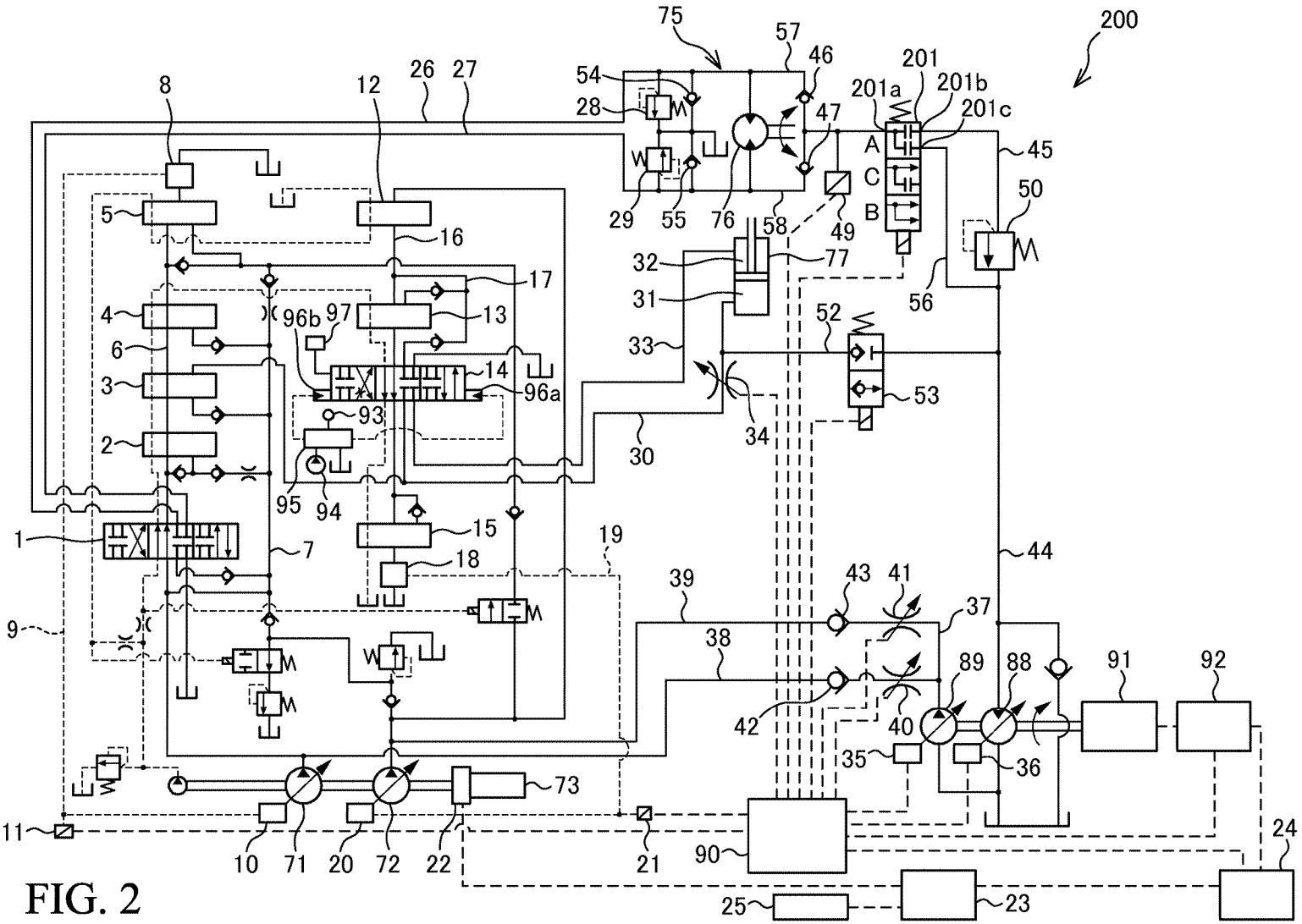
FIG. 2 is a circuit diagram illustrating a control system for a hybrid construction machine according to a second embodiment of the present invention.

A description will be given of a control system 200 for a hybrid construction machine according to a second embodiment of the present invention with reference to FIG. 2. Hereinafter, the difference from the first embodiment described above will be mainly described. Like reference numerals designate configurations with functions corresponding or identical to those in the first embodiment, and therefore such configurations will not be further elaborated here.

In the control system 200 for the hybrid construction machine, the turning regeneration passage 45 is provided with a switching valve 201 as a turning-regeneration-use switching valve with the functions of the switching valve 48 and the bypass valve 51 in the first embodiment described above.

The switching valve 201 is an electromagnetic valve that has three positions of a cut-off position A, a first communicating position B, and a second communicating position C. The switching valve 201 is switched in position by the output signal of the controller 90. The switching valve 201 includes three ports of an inlet port 201*a*, an outlet port 201*b*, and a bypass port 201*c*. The pressure of the turning circuit 75 is introduced into the inlet port 201*a*. The outlet port 201*b* is communicated with the pressure reducing valve 50. The bypass port 201*c* is communicated with the bypass passage 56. The bypass passage 56 connects the bypass port 201*c* of the switching valve 201 with the downstream side of the pressure reducing valve 50 in the turning regeneration passage 45.

In the cut-off position A of the switching valve 201, the respective communications of the outlet port 201*b* and the bypass port 201*c* with the inlet port 201*a* are cut off. In the first communicating position B, the outlet port 201*b* and the bypass port 201*c* are each communicated with the inlet port 201*a*. In the second communicating position C, the outlet port 201*b* is communicated with the inlet port 201*a* while the communication of the bypass port 201*c* with the inlet port 201*a* is cut off.

In the case where the controller 90 determines that the pressure detected by the pressure sensor 49 is less than the turning-regeneration starting pressure, the controller 90 sets the switching valve 201 to the cut-off position A. In the cut-off position A, the working oil from the turning circuit 75 is not introduced into the regenerative motor 88. Thus, the turning regeneration is not performed.

In the case where the controller 90 determines that the pressure detected by the pressure sensor 49 reaches the turning-regeneration starting pressure and that the boom cylinder 77 is during the expansion operation or stopped on the basis of the detection result of the sensor 97, the controller 90 sets the switching valve 201 to the first communicating position B and sets the switching valve 53 to the closed position. That is, in the case where the pressure detected by the pressure sensor 49 reaches the turning-regeneration starting pressure and the switching valve 53 is in the closed position, the switching valve 201 is set to the first communicating position B. Accordingly, only the working oil from the turning circuit 75 is introduced into the regenerative motor 88. Thus, the turning regeneration is performed alone. At this time, the bypass passage 56 is opened by the switching valve 201. Accordingly, the working oil from the turning circuit 75 is introduced into the regenerative motor 88 while bypassing the pressure reducing valve 50. Thus, in the case where the turning regeneration is performed alone, the working oil from the turning circuit 75 is introduced into the regenerative motor 88 without pressure reduction by the pressure reducing valve 50.

In the case where the controller 90 determines that the pressure detected by the pressure sensor 49 reaches the turning-regeneration starting pressure and that the boom cylinder 77 is during the contraction operation on the basis of the detection result of the sensor 97, the controller 90 sets the switching valve 201 to the second communicating position C and sets the switching valve 53 to the opening position. That is, in the case where the pressure detected by the pressure sensor 49 reaches the turning-regeneration starting pressure and the switching valve 53 is in the opening position, the switching valve 201 is set to the second communicating position C. Accordingly, the working oil from the turning circuit 75 and the working oil returning from the boom cylinder 77 are introduced into the regenerative motor 88. Thus, the turning regeneration and the boom regeneration are simultaneously performed. At this time, the turning regeneration passage 45 is opened by the switching valve 201 while the bypass passage 56 is cut off. Accordingly, the working oil from the turning circuit 75 is introduced into the regenerative motor 88 through the pressure reducing valve 50. Thus, in the case where the turning regeneration and the boom regeneration are simultaneously performed, the working oil from the turning circuit 75 is reduced in pressure by the pressure reducing valve 50 and then introduced into the regenerative motor 88.

The second embodiment described above provides operations and effects similar to those in the first embodiment, and eliminates a need for the bypass valve 51 that is necessary in the first embodiment, thus reducing the cost.

<Third Embodiment>

Figure 3:
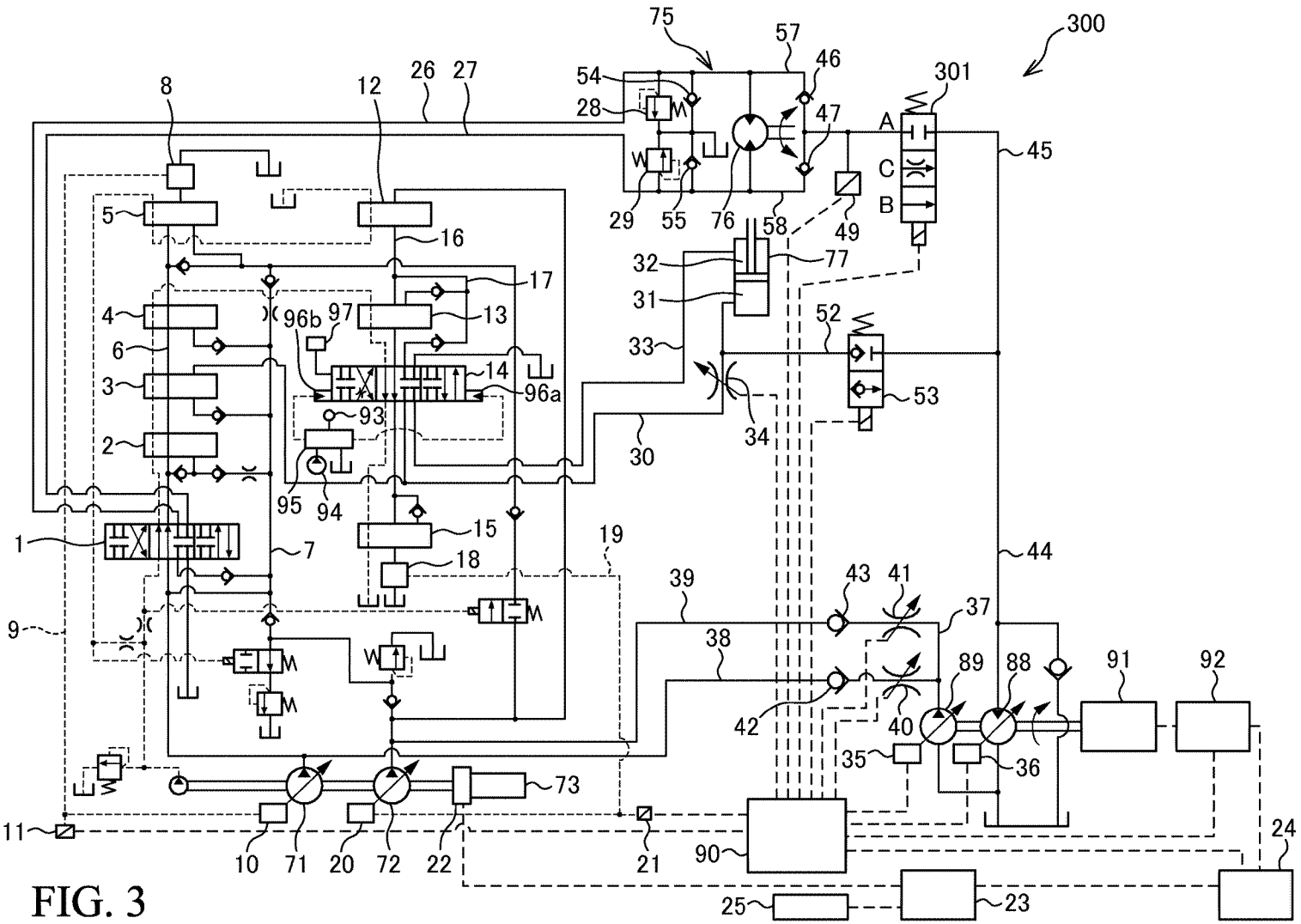
FIG. 3 is a circuit diagram illustrating a control system for a hybrid construction machine according to a third embodiment of the present invention.

A description will be given of a control system 300 for a hybrid construction machine according to a third embodiment with reference to FIG. 3. Hereinafter, the difference from the first embodiment described above will be mainly described. Like reference numerals designate configurations with functions corresponding or identical to those in the first embodiment, and therefore such configurations will not be further elaborated here.

In the control system 300 for the hybrid construction machine, the turning regeneration passage 45 is provided with a switching valve 301 as a turning-regeneration-use switching valve with the functions of the switching valve 48, the pressure reducing valve 50, and the bypass valve 51 in the first embodiment described above.

The switching valve 301 is an electromagnetic valve that has three positions of a cut-off position A, a first communicating position B, and a second communicating position C. The switching valve 301 is switched in position by the output signal of the controller 90. The switching valve 301 cuts off the turning regeneration passage 45 in the cut-off position A, introduces the working oil from the turning circuit 75 into the regenerative motor 88 without pressure reduction in the first communicating position B, and reduces the pressure of the working oil from the turning circuit 75 by throttling so as to introduce the working oil into the regenerative motor 88 in the second communicating position C.

In the case where the controller 90 determines that the pressure detected by the pressure sensor 49 is less than the turning-regeneration starting pressure, the controller 90 sets the switching valve 301 to the cut-off position A. In the cut-off position A, the working oil from the turning circuit 75 is not introduced into the regenerative motor 88. Thus, the turning regeneration is not performed.

In the case where the controller 90 determines that the pressure detected by the pressure sensor 49 reaches the turning-regeneration starting pressure and that the boom cylinder 77 is during the expansion operation or stopped on the basis of the detection result of the sensor 97, the controller 90 sets the switching valve 301 to the first communicating position B and sets the switching valve 53 to the closed position. That is, in the case where the pressure detected by the pressure sensor 49 reaches the turning-regeneration starting pressure and the switching valve 53 is in the closed position, the switching valve 301 is set to the first communicating position B. Accordingly, only the working oil from the turning circuit 75 is introduced into the regenerative motor 88. Thus, the turning regeneration is performed alone. At this time, the working oil from the turning circuit 75 is introduced into the regenerative motor 88 without pressure reduction by the switching valve 301. Thus, in the case where the turning regeneration is performed alone, the working oil from the turning circuit 75 is introduced into the regenerative motor 88 without pressure reduction.

In the case where the controller 90 determines that the pressure detected by the pressure sensor 49 reaches the turning-regeneration starting pressure and that the boom cylinder 77 is during the contraction operation on the basis of the detection result of the sensor 97, the controller 90 sets the switching valve 301 to the second communicating position C and sets the switching valve 53 to the opening position. That is, in the case where the pressure detected by the pressure sensor 49 reaches the turning-regeneration starting pressure and the switching valve 53 is in the opening position, the switching valve 301 is set to the second communicating position C. Accordingly, the working oil from the turning circuit 75 and the working oil returning from the boom cylinder 77 are introduced into the regenerative motor 88. Thus, the turning regeneration and the boom regeneration are simultaneously performed. At this time, the working oil from the turning circuit 75 is throttled by the switching valve 301 and then introduced into the regenerative motor 88. Thus, in the case where the turning regeneration and the boom regeneration are simultaneously performed, the working oil from the turning circuit 75 is reduced in pressure by throttling and then introduced into the regenerative motor 88.

The third embodiment described above provides operations and effects similar to those in the first embodiment, and eliminates a need for the pressure reducing valve 50, the bypass passage 56, and the bypass valve 51 that are necessary in the first embodiment, thus reducing the cost.

The following describes modifications of the third embodiment.

The switching valve 301 may be constituted by an electromagnetic proportional throttle valve whose degree of opening is controlled by the output signal of the controller 90. In this case, the controller 90 sets the opening area of the throttling of the switching valve 301 to maximum in the case where the turning regeneration is performed alone. On the other hand, in the case where the turning regeneration and the boom regeneration are simultaneously performed, the controller 90 adjusts the opening area of the throttling of the switching valve 301 such that the differential pressure between the inlet and the outlet of the switching valve 301 becomes constant irrespective of the passing flow. Specifically, the controller 90 computes a theoretical turning-regeneration flow from the pressure detected by the pressure sensor 49 and adjusts the opening area of the throttling on the basis of the theoretical turning-regeneration flow. It should be noted that the pilot pressure may be controlled by the output signal of the controller 90 so as to control the opening area of the throttling using this pilot pressure in the case where the switching valve 301 is thus configured.

Embodiments of this invention were described above, but the above embodiments are merely examples of applications of this invention, and the technical scope of this invention is not limited to the specific constitutions of the above embodiments.

This application claims priority based on Japanese Patent Application No.2012-245559 filed with the Japan Patent Office on Nov. 7, 2012, the entire contents of which are incorporated into this specification.

The invention claimed is:

1. A control system for a hybrid construction machine, comprising:

a fluid pressure pump as a driving source of a turning motor and a fluid pressure cylinder;

a regenerative motor for regeneration and being configured to rotate by a working fluid introduced from a turning circuit for driving the turning motor, and a working fluid introduced from the fluid pressure cylinder;

a rotating electrical machine coupled to the regenerative motor;

a pressure detector configured to detect a turning pressure during a turning operation or a brake pressure during a braking operation of the turning motor;

a turning-regeneration-use switching valve configured to open when a pressure detected by the pressure detector reaches a preliminarily set turning-regeneration starting pressure, so as to introduce the working fluid from the turning circuit to the regenerative motor for turning regeneration;

an operating-state detector configured to detect an operating state of the fluid pressure cylinder;

a cylinder-regeneration-use switching valve disposed in parallel to the turning-regeneration-use switching valve, the cylinder-regeneration-use switching valve being configured to open on the basis of a detection result of the operating-state detector, so as to introduce the working fluid from the fluid pressure cylinder to the regenerative motor for cylinder regeneration;

a turning regeneration passage provided with the turning-regeneration-use switching valve;

a cylinder regeneration passage provided with the cylinder-regeneration-use switching valve;

a junction regeneration passage to which the turning regeneration passage and the cylinder regeneration passage are joined and connected, the junction regeneration passage being configured to introduce a working fluid to the regenerative motor;

a pressure reducing valve provided at a downstream side of the turning-regeneration-use switching valve in the turning regeneration passage;

a bypass passage connected to the turning regeneration passage, the bypass passage bypassing the pressure reducing valve; and a bypass valve provided in the bypass passage, the bypass valve having a cut-off position and a communicating position, wherein when the turning regeneration is performed alone, the working fluid from the turning circuit is introduced into the regenerative motor without pressure reduction, when the turning regeneration and the cylinder regeneration are simultaneously performed, the working fluid from the turning circuit is reduced in pressure, joins the working fluid from the fluid pressure cylinder, and is introduced into the regenerative motor, and the bypass valve is set to the communicating position when the turning regeneration is performed alone, and being set to the cut-off position when the turning regeneration and the cylinder regeneration are simultaneously performed.

2. The control system for the hybrid construction machine according to claim 1, further comprising an operation valve operated by a pilot pressure to control a flow of a working fluid to be introduced from the fluid pressure pump to the fluid pressure cylinder, wherein the bypass valve is set to the cut-off position by a pilot pressure that operates the operation valve in a direction along which a load-side pressure chamber of the fluid pressure cylinder contracts.

3. The control system for the hybrid construction machine according to claim 1, further comprising a controller configured to perform a regenerative control for the hybrid construction machine, wherein the regenerative motor is a variable displacement-type motor with an adjustable tilting angle, and the controller is configured to control a tilting angle and a rotational speed of the regenerative motor such that a pressure detected by the pressure detector does not become lower than the turning-regeneration starting pressure when the turning regeneration is performed alone.

4. The control system for the hybrid construction machine according to claim 3, wherein the controller is configured to compute a theoretical turning-regeneration flow from a pressure detected by the pressure detector; and control a tilting angle and a rotational speed of the regenerative motor such that a regeneration flow to be introduced into the regenerative motor does not exceed the theoretical turning-regeneration flow.

5. A control system for a hybrid construction machine, comprising:

a fluid pressure pump as a driving source of a turning motor and a fluid pressure cylinder;

a regenerative motor for regeneration and being configured to rotate by a working fluid introduced from a turning circuit for driving the turning motor, and a working fluid introduced from the fluid pressure cylinder;

a rotating electrical machine coupled to the regenerative motor;

a pressure detector configured to detect a turning pressure during a turning operation or a brake pressure during a braking operation of the turning motor;

a turning-regeneration-use switching valve configured to open when a pressure detected by the pressure detector reaches a preliminarily set turning-regeneration starting pressure, so as to introduce the working fluid from the turning circuit to the regenerative motor for turning regeneration;

an operating-state detector configured to detect an operating state of the fluid pressure cylinder; and a cylinder-regeneration-use switching valve disposed in parallel to the turning-regeneration-use switching valve, the cylinder-regeneration-use switching valve being configured to open on the basis of a detection result of the operating-state detector, so as to introduce the working fluid from the fluid pressure cylinder to the regenerative motor for cylinder regeneration;

a turning regeneration passage provided with the turning-regeneration-use switching valve;

a cylinder regeneration passage provided with the cylinder-regeneration-use switching valve;

a junction regeneration passage to which the turning regeneration passage and the cylinder regeneration passage are joined and connected, the junction regeneration passage being configured to introduce a working fluid to the regenerative motor;

a pressure reducing valve provided at a downstream side of the turning-regeneration-use switching valve in the turning regeneration passage; and a bypass passage connected to the turning regeneration passage, the bypass passage bypassing the pressure reducing valve, wherein when the turning regeneration is performed alone, the working fluid from the turning circuit is introduced into the regenerative motor without pressure reduction, when the turning regeneration and the cylinder regeneration are simultaneously performed, the working fluid from the turning circuit is reduced in pressure, joins the working fluid from the fluid pressure cylinder, and is introduced into the regenerative motor, the turning-regeneration-use switching valve is set to a cut-off position when a pressure detected by the pressure detector is less than the turning-regeneration starting pressure, the turning-regeneration-use switching valve is set to a first communicating position to open the bypass passage when a pressure detected by the pressure detector reaches the turning-regeneration starting pressure and the cylinder-regeneration-use switching valve is in a valve closed state, and the turning-regeneration-use switching valve is set to a second communicating position to open the turning regeneration passage and cut off the bypass passage when a pressure detected by the pressure detector reaches the turning-regeneration starting pressure and the cylinder-regeneration-use switching valve is in a valve open state.

6. The control system for the hybrid construction machine according to claim 5, further comprising a controller configured to perform a regenerative control for the hybrid construction machine, wherein the regenerative motor is a variable displacement-type motor with an adjustable tilting angle, and the controller is configured to control a tilting angle and a rotational speed of the regenerative motor such that a pressure detected by the pressure detector does not become lower than the turning-regeneration starting pressure when the turning regeneration is performed alone.

7. The control system for the hybrid construction machine according to claim 6, wherein the controller is configured to compute a theoretical turning-regeneration flow from a pressure detected by the pressure detector; and control a tilting angle and a rotational speed of the regenerative motor such that a regeneration flow to be introduced into the regenerative motor does not exceed the theoretical turning-regeneration flow.

8. A control system for a hybrid construction machine, comprising:

a fluid pressure pump as a driving source of a turning motor and a fluid pressure cylinder;

a regenerative motor for regeneration and being configured to rotate by a working fluid introduced from a turning circuit for driving the turning motor, and a working fluid introduced from the fluid pressure cylinder;

a rotating electrical machine coupled to the regenerative motor;

a pressure detector configured to detect a turning pressure during a turning operation or a brake pressure during a braking operation of the turning motor;

a turning-regeneration-use switching valve configured to open when a pressure detected by the pressure detector reaches a preliminarily set turning-regeneration starting pressure, so as to introduce the working fluid from the turning circuit to the regenerative motor for turning regeneration;

an operating-state detector configured to detect an operating state of the fluid pressure cylinder; and a cylinder-regeneration-use switching valve disposed in parallel to the turning-regeneration-use switching valve, the cylinder-regeneration-use switching valve being configured to open on the basis of a detection result of the operating-state detector, so as to introduce the working fluid from the fluid pressure cylinder to the regenerative motor for cylinder regeneration, wherein when the turning regeneration is performed alone, the working fluid from the turning circuit is introduced into the regenerative motor without pressure reduction, when the turning regeneration and the cylinder regeneration are simultaneously performed, the working fluid from the turning circuit is reduced in pressure, joins the working fluid from the fluid pressure cylinder, and is introduced into the regenerative motor, the turning-regeneration-use switching valve is set to a cut-off position when a pressure detected by the pressure detector is less than the turning-regeneration starting pressure, the turning-regeneration-use switching valve is set to a first communicating position to introduce the working fluid from the turning circuit into the regenerative motor without pressure reduction when a pressure detected by the pressure detector reaches the turning-regeneration starting pressure and the cylinder-regeneration-use switching valve is in a valve closed state, and the turning-regeneration-use switching valve is set to a second communicating position to throttle the working fluid from the turning circuit and introduce the working fluid into the regenerative motor when a pressure detected by the pressure detector reaches the turning-regeneration starting pressure and the cylinder-regeneration-use switching valve is in a valve open state.

9. The control system for the hybrid construction machine according to claim 8, further comprising a controller configured to perform a regenerative control for the hybrid construction machine, wherein the regenerative motor is a variable displacement-type motor with an adjustable tilting angle, and the controller is configured to control a tilting angle and a rotational speed of the regenerative motor such that a pressure detected by the pressure detector does not become lower than the turning-regeneration starting pressure when the turning regeneration is performed alone.

10. The control system for the hybrid construction machine according to claim 9, wherein the controller is configured to compute a theoretical turning-regeneration flow from a pressure detected by the pressure detector; and control a tilting angle and a rotational speed of the regenerative motor such that a regeneration flow to be introduced into the regenerative motor does not exceed the theoretical turning-regeneration flow.

* * * * *